United States Patent [19]

Schibbye et al.

[11] 3,932,073

[45] Jan. 13, 1976

[54] SCREW ROTOR MACHINE WITH SPRING AND FLUID BIASED BALANCING PISTONS

[75] Inventors: Hjalmar Schibbye, Saltsjo-Boo; Arnold Englund, Vallingby, both of Sweden

[73] Assignee: Svenska Rotor Maskiner Aktiebolag, Nacka, Sweden

[22] Filed: July 1, 1974

[21] Appl. No.: 484,983

[30] Foreign Application Priority Data

July 5, 1973 United Kingdom ..... 32126/73

[52] U.S. Cl. ..... 418/97; 418/203

[51] Int. Cl.[2] ..... F01C 1/16; F04C 17/12; F01C 21/04

[58] Field of Search ..... 418/97, 203; 415/96, 104–107

[56] References Cited

UNITED STATES PATENTS

| | | | |
|---|---|---|---|
| 1,218,602 | 3/1917 | Holdaway | 418/203 |
| 1,677,980 | 7/1928 | Montelius | 418/203 |
| 2,654,530 | 10/1953 | Oldberg | 418/203 |
| 2,864,552 | 12/1958 | Anderson | 415/105 |
| 3,161,349 | 12/1964 | Schibbye | 418/203 |
| 3,388,854 | 6/1968 | Olofsson et al. | 418/203 |
| 3,658,452 | 4/1972 | Kita | 418/203 |

FOREIGN PATENTS OR APPLICATIONS

| | | | |
|---|---|---|---|
| 1,334,304 | 10/1973 | United Kingdom | 418/203 |

*Primary Examiner*—John J. Vrablik
*Attorney, Agent, or Firm*—Flynn & Frishauf

[57] ABSTRACT

A screw rotor machine for an elastic working fluid in which the rotors are biassed towards the high pressure end wall by means of balancing pistons and interposed bearings.

8 Claims, 6 Drawing Figures

SCREW ROTOR MACHINE WITH SPRING AND FLUID BIASED BALANCING PISTONS

This invention relates to screw rotor machines for use as compressors and expanders of an elastic working fluid such as a gas.

A screw compressor in accordance with this invention is suitable for use in air conditioning apparatus, for example, automotive air conditioning apparatus. In this specification the term air conditioning is used to include the refrigeration of air and other gaseous media as well as air conditioning per se.

In this specification the term "screw rotor machine" refers to a machine having a housing structure including a barrel portion comprising intersecting bores with co-planar axes forming a working space extending longitudinally of the barrel portion which has a high pressure end wall, the structure having a low pressure port communicating with one end of the working space the major portion of which port is located at one side of the plane of the axes of the intersecting bores and a high pressure port communicating with the other and high pressure end of the working space the major portion of which port is located at the opposite side of the said plane. Male and female rotors are rotatably mounted in the respective bores and have meshing helical lands and grooves with an effective wrap angle of less than 360°, the lands of the male rotor having substantially convexly curved flanks and intervening grooves the major portions of which are outside the pitch circle of the male rotor and the lands of the female rotor having substantially concavely curved flanks and intervening grooves the major portions of which lie inside the pitch circle of the female rotor, the lands and grooves of the rotors intermeshing to form with confronting portions of said housing structure chevronshaped closed chambers each comprising a portion of the male rotor groove and a portion of the communicating female rotor groove. The chambers are defined at their base ends by the high pressure end wall of the working space and at their apex ends by the places of intermesh between the lands of the rotors, the apex ends moving (when the machine is used as a compressor) axially towards the high pressure end wall as the rotors revolve to decrease the volume of the chambers which move into communication serially with said high pressure port means is provided for supplying liquid to the working space for sealing the perimeters of the chambers and cooling the contents thereof.

Owing to the pressure difference existing between the high and low pressure ports during operation of screw rotor machines of the type described, the rotors are subjected to axial forces due at least in part to the forces created by the elastic fluid and to the contact forces between the meshing rotors. These axial forces necessitate on one hand means for fixing the rotors in relation to the housing structure and on the other hand means for transmitting the forces from the rotors to the housing structure. Hitherto, the axial forces have been carried by thrust bearings.

The space or clearance between the high pressure end wall of the working space and the high pressure ends of the rotors forms a channel between the portions of the grooves communicating with the high pressure and low pressure ports, respectively, so that too large a space will cause considerable leakage losses. For this reason it is of very great importance that the space between the rotor ends and the end wall is kept as small as possible. The extent of the space depends in the first place on the clearance and elasticity of the thrust bearings and the type of trust bearings used has, therefore, been an important factor in the design of screw rotor machines.

Our investigations have shown that the space or clearance between the high pressure end wall of the working space and the high pressure ends of the rotors of diameter (40–400mm) should generally be within the range 0.02 to 0.15 mm.

In order to maintain a clearance within such a range, accurate and reliable thrust bearings and devices for adjusting the clearance have been included in the screw rotor machine. Such bearings and devices are expensive items and they represent a higher proportion of the overall cost of smaller machines having rotor diameters approaching the lower end of the range than of larger machines having rotor diameters approaching the upper end of the range given above. Moreover, the clearance for smaller compressors is considerably smaller than for larger compressors and this necessitates paying greater attention to manufacturing tolerances and requires greater skills on the part of the technicians assembling and adjusting the machines prior to delivery to a customer.

SUMMARY OF THE INVENTION

According to the present invention, a screw rotor machine of the type described is characterized in that each rotor is connected via an axial bearing, for example a needle bearing, to an associated balancing piston mounted to impose a biassing force on the appropriate rotor to bias it in a direction towards the high pressure end wall of the housing structure, at least a part of the said end wall constituting a thrust bearing surface for the rotors.

The rotors may be biassed towards the high pressure end wall by means, of gas pressure, liquid pressure or mechanical pressure, for example a spring, or any combination of such means. The screw rotor machine of the invention is preferably a so-called wet-machine, that is, oil is injected into the working space to lubricate the rotors and oil from the pressurized lubricating oil system may also be used for biassing the rotors towards the high pressure end wall.

Conveniently, each piston operates directly or indirectly upon a rotor extension or shaft located at the low pressure end of the machine.

Preferably the balancing piston associated with at least the driving rotor, for example, the female rotor, is permanently biassed towards the high pressure end wall by means of, for example, a spring operating on the piston. Such permanent biassing force is additional to the biassing force imposed by the balancing piston(s) per se.

Alternatively, each rotor may be formed with an extension or shaft at the high pressure end of the machine. In this alternative, each shaft or extension may be fitted or formed with an annular flange sealingly disposed within a chamber. A spring or other biassing means may be used to bias the said annular flange and, consequently, the rotor in a direction towards the high pressure end wall.

The biassing of the rotor or rotors may, therefore, as indicated, be achieved by a spring having a predetermined biassing force and according to the working conditions, this force could be supplemented by a piston operation on an elastic fluid in a cylinder formed between the piston, the annular flange and the chamber wall. Conveniently, the balancing forces are sufficiently large to enable available oil pressure, that is the pressure of oil used for lubricating the rotors, not only to balance the axial forces but also to overbalance them so that the resulting axial force is negative, that is, directed towards the high pressure end wall.

BRIEF DESCRIPTION OF THE DRAWINGS

A screw rotor machine in accordance with the present invention and adapted to operate as a compressor will now be described by way of example with reference to the accompanying drawings in which.

DETAILED DESCRIPTION OF ILLUSTRATED EMBODIMENTS

The compressor shown has a male rotor 10 and a cooperating female rotor 12 (see FIGS. 2 and 3) having helical lands and intervening grooves. The major portions of the lands of the male rotor 10 lie outside the pitch circle of the rotor and have substantially convexly curved flanks. The major portions of the female rotor 12 lie inside the pitch circle of the rotor and have substantially concavely curved flanks. The wrap angle of each land is less than 360° on each rotor.

Figure 1:
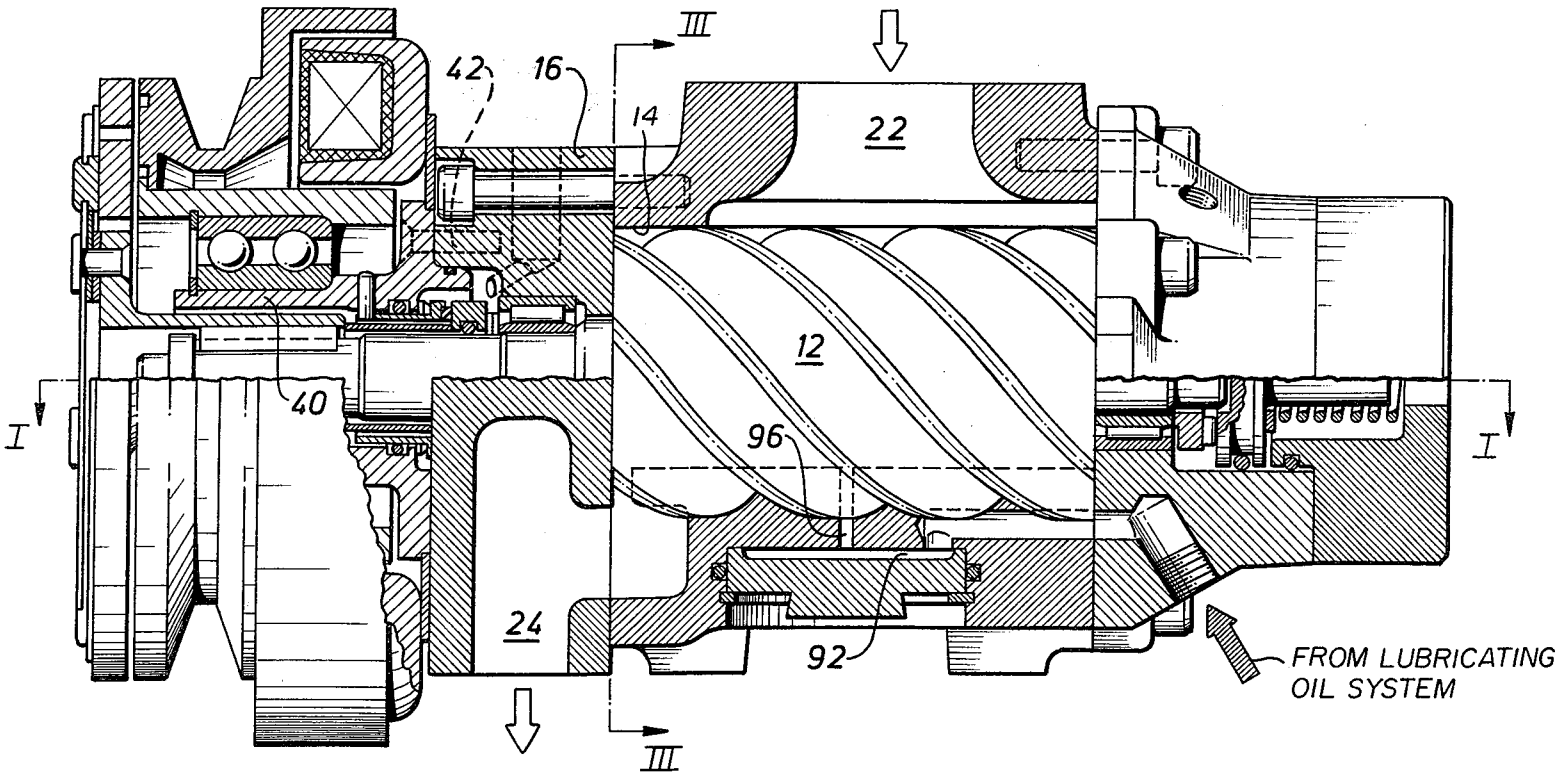
FIG. 1 is a section taken along B—B of FIG. 2.

The rotors 10 and 12 are located in a housing structure having a barrel portion 14 and with end walls 16 and 18 enclosing a working space 20 comprising two intersecting bores. The working space 20 has a low pressure port 22 (FIG. 1) and a high pressure port 24 (FIG. 1).

The male rotor 10 is formed with shaft extensions 10A and 10B (FIG. 2) to facilitate mounting of this rotor in the end walls 16 and 18 by means of roller bearings 26 and 28 which principally carry radial forces acting on the rotor.

Figure 2:
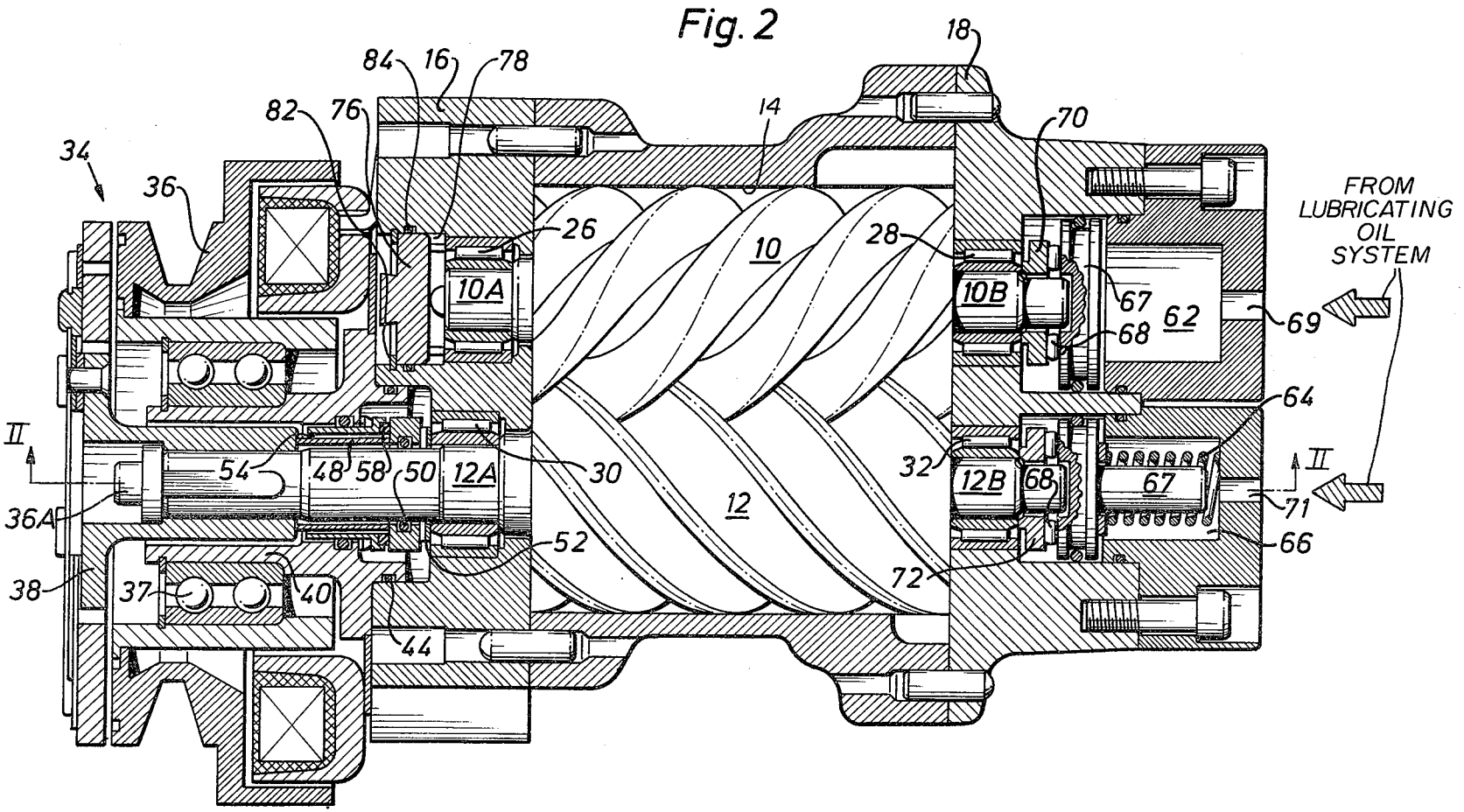
FIG. 2 is a section taken along A—A of FIG. 1.
Figure 3:
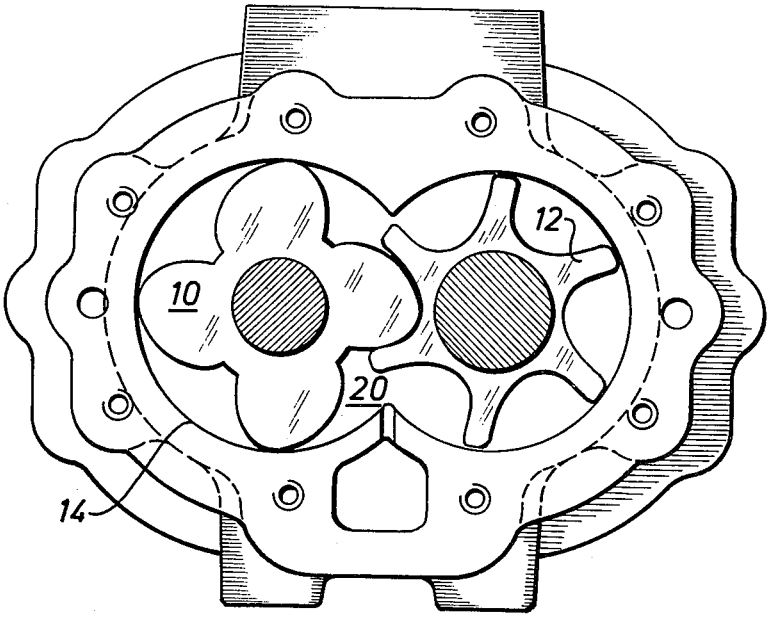
FIG. 3 is a section taken along C—C of FIG. 1.

The female rotor 12 which in the case of the compressor exemplified is the driving rotor, has a stub extension 12B and a somewhat longer extension 12A (FIG. 2). The female rotor is supported in the end walls 16 and 18 by two roller bearings 30 and 32 which, as in the case of the male rotor, principally carry the radial forces acting on the female rotor. Drive to the female rotor is effected via a V-pulley which forms a part of a magnetic clutch assembly 34 (FIG. 2). A part 36 of the magnetic clutch assembly is supported on the outer race of a double roller bearing 37 whereas a part 38 of the magnetic clutch is keyed and screwed at 36A to the extension 12A of the female rotor 12. The inner race of the double roller bearing 37 is carried upon a sleeve 40 which, in turn and as shown in FIG. 1, is secured by screws 42 into the end plate 16. The sleeve 40 is sealed against the end plate 16 by means of an O-ring seal 44. Located between the part 38 of the magnetic clutch and the roller bearing 30 is a spacer and sealing arrangement comprising a first end spacer sleeve 48 and a seal 50, separated from the inner race of roller bearing 30 by a spring washer 52.

A second and outer sleeve 54 is located between the seal 50 and the sleeve 48 and this also carries a seal 58.

The axial load applied to the meshing screw rotors 10, 12 is taken up on the high pressure end plate 16 and the pressure urging the rotors against the end plate 16 is accomplished by means of a piston 67 arrangement operable on axial needle or roller bearings 68 carried on the stub shafts 10B and 12B of the male and the female rotors.

In FIG. 2 the biassing force applied to the piston 67 and consequently the male rotor is achieved by means of fluid pressure in cavity 62 supplied via an opening 69 whereas the biassing force on the female rotor is accomplished by means of a combination of a spring force obtained from spring 64 and fluid pressure fed into the cavity 66 via an opening 71. The pressure or biassing force applied to the pistons 67 associated with the male and female rotors is transmitted to the repsective rotors by the axial bearings 68 and sleeves 70 and 72 which cooperate with the inner races of the bearings 28 and 32.

Figure 4:
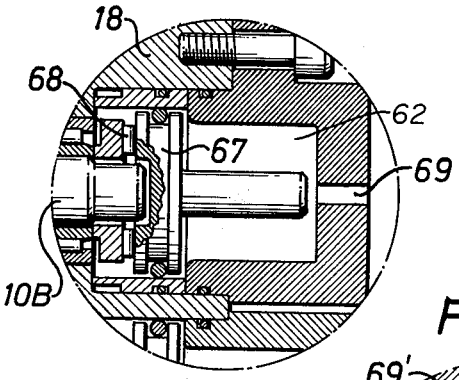
FIGS. 4, 5 and 6 are alternative constructions for biassing the male rotor of the compressor.
Figure 5:
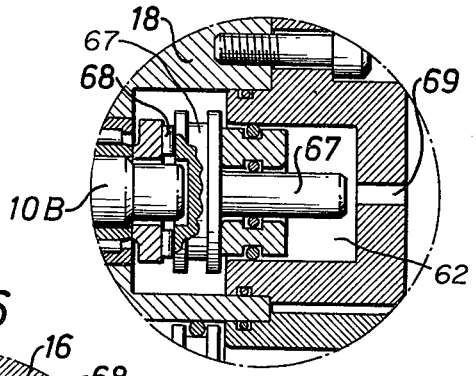
Figure 6:
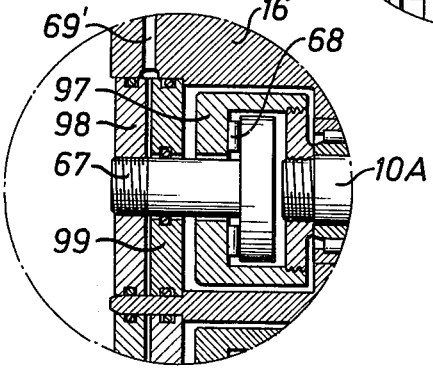

Three alternative forms of piston arrangements for biassing the male rotor towards the high pressure end wall of the compressor are shown in FIGS. 4, 5 and 6 and these alternative arrangements rely entirely upon fluid pressure for biassing the piston and consequently the rotor in a direction towards the high pressure end wall.

In FIG. 6 shaft 10A is provided with a flange portion 97 by means of which the balance piston 67 is biassing the rotor towards the high pressure end wall 16 under the agency of gas or liquid pressure supplied via an opening 69' to an interspace between a circular disk 98 forming a part of the piston 67 and an annular wall 99 attached to the end wall 16.

The radial load carrying roller bearing 26 supporting the male rotor 10 at the high pressure end is held in place by a disk 76 fitted with projections 78 which abut the inner race of the bearing. The disk is maintained in position by means of a circlip 82 and an O-ring seal 84 seals the disk in the high pressure end wall.

For lubrication purposes a lubricating oil is forced into the working space through one or more channels 96 (FIG. 1) which communicate with a lubricating oil reservoir 92. The channels 96 may be inclined in an axial direction or may be formed at right angles to the axes of the rotors.

From the foregoing, it will be appreciated that the axial forces resulting on the rotors is taken up by the high pressure end wall and the high pressure ends of the rotors and that these said surfaces constitute a plain thrust bearing. If desired, certain parts of one or more of the said surfaces may be relieved.

With a machine as described the following advantages are obtained.

1. The machine should be considerably cheaper to manufacture as the axial bearings and the device for adjusting the axial clearances are eliminated as well as the time consuming work to set up the compressor with exact axial clearances.

2. The leakage over the outlet ends of the rotors should cease almost entirely as there should be no axial clearance between the rotors and the high pressure end wall. These surfaces are separated only by a supporting oil film. Thus, also from the view of efficiency the design should be optimal.

3. By draining the back of the balancing pistons to a close thread the negative effect of oil leakage from the balancing plunges to the compressor inlet should be considerably reduced if not entirely eliminated.

For certain compressor applications the running conditions will vary considerably. This is particularly the case for compressors intended for use in atuomotive air conditioning apparatus where the inlet pressure as well as the outlet pressure, speed, etc. will constantly vary and which will cause difficulties in dimensioning the balancing pistons.

If the balancing pistons are dimensioned for a adequate over balancing of the axial forces for one set of operating conditions they might be under balanced for another set of conditions, whereas for a third condition they will be over balanced to too high a degree.

One solution to this problems is to let the inlet and outlet pressures of the compressor control the pressure on the balancing pistons by means of an automatic valve, for example, an expansion valve, which connects the high pressure side of the balancing pistons with a closed chevron-shaped chamber in the compressor and so as to control the balancing force to the actual working condition.

The control or automatic valve should operate in such a way that by increasing the pressure difference over the compressor the valve will open and attain a pressure drop over a throttling device between an oil separator and the balancing piston (s) whereby the balancing force corresponds to the actual working condition.

Compressors according to this invention may also be used for other applications employing more constant running conditions where ordinary thrust bearings are less advisable with regard to the cost and where only one size of balancing piston is preferable from the manufacturing point of view. In such a case the automatic or control valve could be applied in order to adjust the over balancing force to the required working condition. From manufacturing and assembly point of view such a construction will be simple and cheap. The valve could, if desired, be built into the compressor housing, for example, a membrane and spring could be used in a space in the inlet housing and the pipe connections for transmitting the pressurised lubricant.

We claim:

1. A screw rotor machine comprising a housing structure including a barrel portion having intersecting bores with coplanar axes forming a working space extending longitudinally of the barrel portion which has a high pressure end wall, the structure having a low pressure port communicating with one end of the working space the major portion of which port is located at one side of the plane of the axes of the intersecting bores and a high pressure port communicating with the other and high pressure end of the working space the major portion of which port is located at the oppsoite side of said plane, and male and female rotors rotatably mounted in the respective bores and having meshing helical lands and grooves with an effective wrap angle of less than 360°, the lands of the male rotor having substantially convexly curved flanks and intervening grooves the major portions of which are outside the pitch circle of the male rotor and the lands of the female rotor having substantially concavely curved flanks and intervening grooves the major portions of which lie inside the pitch circle of the female rotor, the lands and grooves of the rotors intermeshing to form with confronting portions of said housing structure chevron-shaped closed chambers each comprising a portion of the male rotor groove and a portion of the communicating female rotor groove, the chambers being defined at their base ends by the high pressure end wall of the working space and at their apex ends by the places of intermesh between the lands of the rotors, characterized by a plurality of stationary cavities in the housing structure;

a plurality of substantially non-rotatable balancing pistons slideably mounted to respective ones of said stationary cavities in the housing structure and each balancing piston being associated with a respective rotor;

pressure fluid means coupled to said stationary cavities for biassing said balancing pistons so as to impose a biassing force on their respective rotors to bias the respective rotors in a direction towards the high pressure end wall of the housing structure, at least a part of the said end wall comrpising a thrust bearing surface for the rotor;

at least one spring mechanically biassing at least one of said balancing pistons in the same direction as said pressure fluid means; and a plurality of axial bearings, each connecting a respective rotor to its associated balancing piston, said bearings each including a non-rotatable part coupled to a respective balancing piston and supporting sealing means slideably engaging the inner wall of the respective stationary cavity.

2. A machine as claimed in claim 1, wherein at least one rotor includes an extension or shaft having an annular flange cooperating its associated balancing piston through its associated bearing.

3. A machine as claimed in claim 1, wherein the pressure fluid means includes means for biassing the balancing pistons towards the high pressure end wall under the agency of at least one of gas pressure and liquid pressure.

4. A machine as claimed in claim 3, wherein oil from a pressurized lubricating oil system is injected into the working space to lubricate the rotors, the oil from the pressurized lubricating oil system comprising the pressure fluid means biassing the balancing pistons towards the high pressure end wall.

5. A machine as claimed in claim 1, wherein each rotor has an extension or shaft located at the low pressure end of the machine and each balancing piston is coupled to operate upon a rotor via its extension or shaft.

6. A machine as claimed in claim 5 wherein each balancing piston is directly coupled to the axial bearings of its respective rotor.

7. A machine as claimed in claim 1, wherein the balancing piston associated with at least the driving rotor permanently biasses the associated rotor towards the high pressure end wall.

8. A machine as claimed in claim 7,, wherein the driving rotor is the female rotor.

* * * * *

UNITED STATES PATENT AND TRADEMARK OFFICE

CERTIFICATE OF CORRECTION

PATENT NO. : 3,932,073

DATED : January 13, 1976

INVENTOR(S) : Hjalmar SCHIBBYE, et al

It is certified that error appears in the above-identified patent and that said Letters Patent are hereby corrected as shown below:

Column 6, line 34, after "flange cooperating" insert --with--.

Signed and Sealed this

*thirtieth* Day of *March 1976*

[SEAL]

*Attest:*

RUTH C. MASON
*Attesting Officer*

C. MARSHALL DANN
*Commissioner of Patents and Trademarks*